US008319129B2

(12) United States Patent
Nishino

(10) Patent No.: US 8,319,129 B2
(45) Date of Patent: Nov. 27, 2012

(54) KEYBOARD HAVING BACKLIGHT FUNCTION

(75) Inventor: Takeshi Nishino, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 291 days.

(21) Appl. No.: 12/791,031

(22) Filed: Jun. 1, 2010

(65) Prior Publication Data

US 2011/0048908 A1 Mar. 3, 2011

(30) Foreign Application Priority Data

Aug. 28, 2009 (JP) ..... 2009-198261

(51) Int. Cl.
*H01H 9/00* (2006.01)

(52) U.S. Cl. ..... 200/314

(58) Field of Classification Search ..... None
See application file for complete search history.

(56) References Cited

U.S. PATENT DOCUMENTS

| | | | | |
|---|---|---|---|---|
| 5,867,772 | A * | 2/1999 | Jonsson et al. | 455/575.1 |
| 6,686,549 | B2 * | 2/2004 | Douzono et al. | 200/341 |
| 7,525,056 | B2 | 4/2009 | Chiba et al. | |
| 2009/0045986 | A1 * | 2/2009 | Fabrenius et al. | 341/22 |

FOREIGN PATENT DOCUMENTS

JP 2007-280810 10/2007

* cited by examiner

*Primary Examiner* — Vanessa Girardi
(74) *Attorney, Agent, or Firm* — IPUSA, PLLC

(57) ABSTRACT

A keyboard having a backlight function, the keyboard includes a key top having a light permeating region, the key top being where one end of a link member is provided; a membrane sheet having a contact, the contact being conductive when the key top is pushed; a support panel made of metal, the support panel being where another end of the link member is provided; and a light guide plate where a light is guided from a light source. The key top, the membrane sheet, the support panel, and the light guide plate are stacked from a top side; the light guide plate is formed of a member having an elasticity higher than an elasticity of the support panel; and a part of an external edge part of the light guide plate, seen from the top side, projects outside the support panel.

11 Claims, 9 Drawing Sheets

KEYBOARD HAVING BACKLIGHT FUNCTION

CROSS-REFERENCE TO RELATED APPLICATIONS

This patent application is based upon and claims the benefit of priority of Japanese Patent Application No. 2009-198261 filed on Aug. 28, 2009 the entire contents of which are incorporated herein by reference.

BACKGROUND OF THE INVENTION

1. Field of the Invention

The present invention generally relates to keyboards having backlight functions. More specifically, the present invention relates to a keyboard having a backlight function, the keyboard having a light emitting function whereby the keyboard can be operated even under conditions of darkness.

2. Description of the Related Art

A keyboard having a backlight function has been developed, whereby keys are made to emit light so that a user can operate the keyboard even under dark conditions such as in an airplane.

For example, Japanese Laid-Open Patent Application Publication No. 2007-280810 suggests an invention of a keyboard where LEDs (light emitting diodes) which can be continuously used for a long time and a light guide plate are used so that characters printed on key tops are lighted.

However, in the above-mentioned related art keyboard, an end of a link member is provided to the key top and another end of the link member is fixed to a back plate. The back plate is made of a transparent member, namely non-metal. Therefore, the back plate functions as the light guide plate configured to pass the light from a light source. Because of this, when the user pushes down on a key top, a rigid feeling may not be obtained and strength of the entire keyboard may be lacking.

In a case of a member made of metal where another end of the link member is fixed, deformation or the like due to impact during an assembling process of the keyboard may be generated. Hence, attention should be paid to assembling.

SUMMARY OF THE INVENTION

Accordingly, embodiments of the present invention may provide a novel and useful keyboard having a backlight function solving one or more of the problems discussed above.

More specifically, the embodiments of the present invention may provide a keyboard having a backlight function whereby it is possible to assemble the keyboard without degrading a rigid feeling of the keyboard.

Another aspect of the embodiments of the present invention may be to provide a keyboard having a backlight function, the keyboard including:

a key top having a light permeating region, the key top being where one end of a link member is provided;

a membrane sheet having a contact, the contact being conductive when the key top is pushed;

a support panel made of metal, the support panel being where another end of the link member is provided; and a light guide plate where a light is guided from a light source;

wherein the key top, the membrane sheet, the support panel, and the light guide plate are stacked from a top side;

the light guide plate is formed of a member having an elasticity higher than an elasticity of the support panel; and a part of an external edge part of the light guide plate, seen from the top side, projects outside the support panel.

Another aspect of the embodiments of the present invention may be to provide a keyboard having a backlight function, the keyboard including:

a key top having a light permeating region, the key top being where one end of a link member is provided;

a switch panel where another end of the link member is provided;

a membrane sheet having a contact, the Contact being conductive when the key top is pushed;

a support panel fixed to a housing; and a light guide plate where a light is guided from a light source;

wherein the key top, the switch panel, the membrane sheet, the support panel, and the light guide plate are stacked from a top side;

the light guide plate is formed of a member having an elasticity higher than an elasticity of the support panel; and a part of an external edge part of the light guide plate, seen from the top side, projects outside the support panel.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 9 of embodiments of the present invention.

First Embodiment

A keyboard 1 having a backlight function of a first embodiment of the present invention is discussed with reference to FIG. 1.

Figure 1:
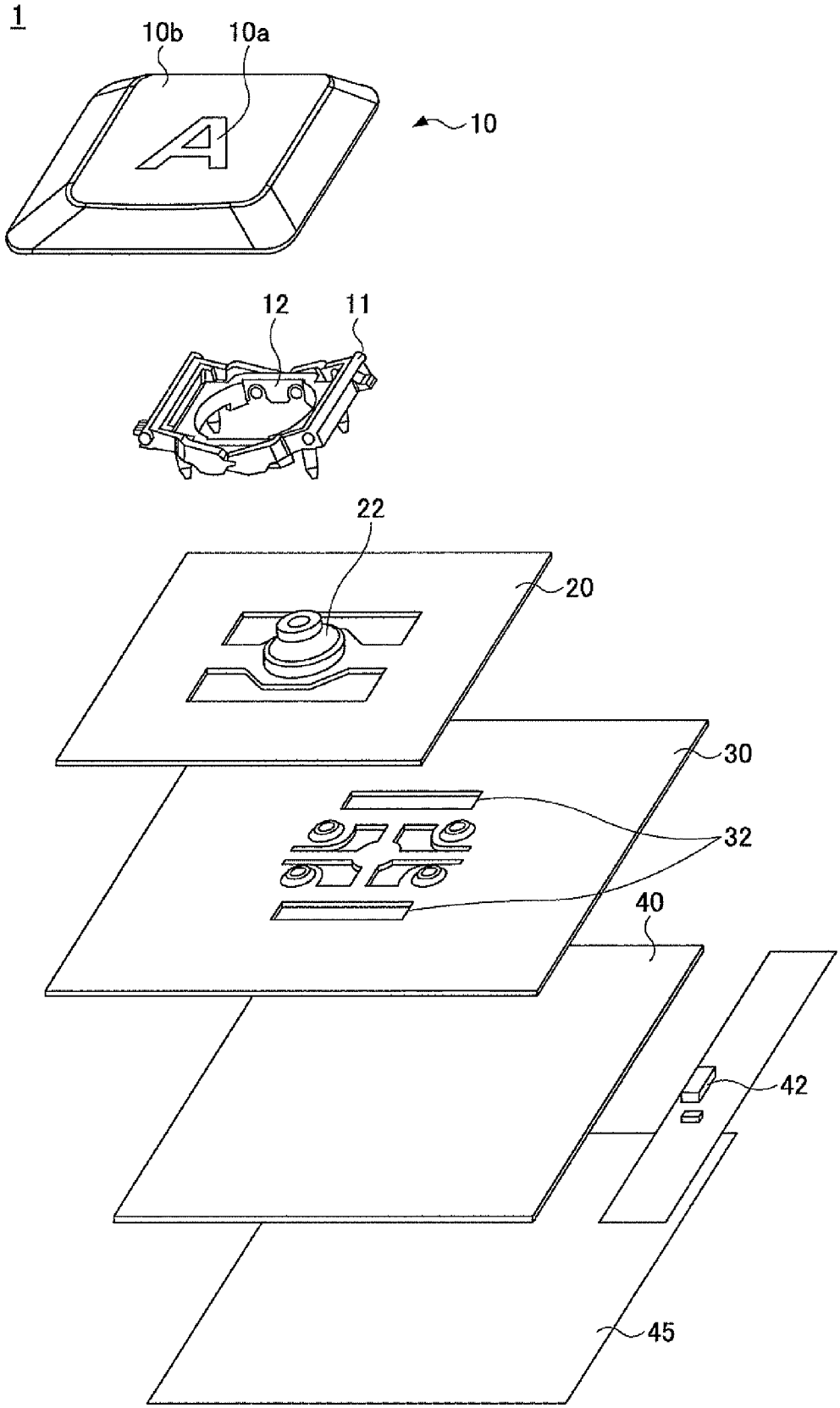
FIG. 1 is an exploded perspective view of a keyboard 1 having a backlight function of a first embodiment of the present invention.

FIG. 1 is an exploded perspective view of the keyboard 1 having the backlight function of the first embodiment of the present invention. The keyboard 1 having the backlight function has a structure where plural key tops 10, a gear link 11 and a housing 12, a membrane sheet 20, a support panel 30, a light guide plate 40, and a reflection sheet 45 are stacked from the top.

The user performs a pushing-down operation onto the key top 10. When the key top 10 is pushed down by the user, the keyboard 1 having the backlight function transmits a signal to a computer (not shown in FIG. 1).

A light resistant region 10*a* and a light permeating region 10*b* are formed in the key top 10. More specifically, a black color light-resistant (absorbing) paint is applied to a surface of a member made of transparent or translucent resin; and a laser light is irradiated on only a portion where the light is to permeate and be emitted, so that the black color light-resistant paint is removed. As a result of this, the transparent or translucent resin surface is exposed so that the light permeating region 10*b* is formed. At this time, a region where the black color light-resistant paint remains is the light resistant region 10*a*.

The light permeating region 10*b* is formed so as to include a configuration of a character or a mark (symbol). When the light irradiated from a rear surface permeates the light permeating region 10*b*, the key top 10 emits a light pattern including a character or mark shape. The light resistant paint may be applied by masking a portion where the light is to be emitted.

In addition, the key top 10 may be formed by double molding where transparent or translucent resin and resin through which the light does not permeate are used. More specifically, a part having a configuration of the key top 10 where a portion corresponding to the character or mark is punched out is formed by the resin where the light does not permeate. This part is the light resistant region 10*a*. After that, the portion corresponding to the punched out character or mark is formed by the transparent or translucent resin and then this part is engaged with the light resistant region 10*a*, so that the key top 10 emitting a light pattern including a character or mark shape when the light transmitted from a rear surface permeates the light permeating region 10*b* can be formed.

The gear link 11 and the housing part 12 are provided at a rear surface side of the key top 10. The gear link 11 and the housing part 12 are configured to move up and down with the key top 10. An end part of the gear link 11 is provided to contact the key top 10, and another end part of the gear link 11 is provided to be mounted on the support panel 30 via the housing part 12. The housing part 12 is made of transparent or translucent light-permeable resin.

The membrane sheet 20 has a structure where an upper part sheet, a spacer sheet, and a lower part sheet are stacked. Electrode patterns are formed at the upper part sheet and the lower part sheet. The upper part sheet, the spacer sheet, and the lower part sheet are made of transparent or translucent light-permeable resin. In addition, each electrode pattern is formed of a transparent electrode made of conductive polymer so that the light permeates the electrode pattern. It is not necessary that the entire membrane sheet 20 have light permeability. Only a portion of the membrane sheet 20 facing the key top 10 may have the light permeability.

A rubber actuator 22 is provided at a portion of the membrane sheet 20 facing the key top 10. The rubber actuator 22 is deformed based on up and down movements of the key top 10. The rubber actuator 22 exerts a force whereby the key top 10 returns to an original position after the key top 10 is pushed. This force causes a reaction force so that the key top 10 is pushed up via the gear link 11. The rubber actuator 22 has elasticity and is made of transparent or translucent light-permeable resin.

Under this structure, based on up and down movements of the key top 10, the electrode patterns come in contact with each other via the gear link 11 and the rubber actuator 22. This structure forms an electrical contact.

In other words, based on up and down movements of the key top 10, the electrode pattern provided at the upper part sheet and the electrode pattern provided at the lower part sheet come in contact with each other at the opening parts of the spacer sheet 20. This structure forms the contact.

The support panel 30 is a plate-shaped member made of metal. The support panel 30 is configured to maintain rigidity of the entire keyboard and generate a rigid feeling when the key top 10 is pushed down. Opening parts 32 through which the light passes are provided in the support panel 30. The support panel 30 is fixed to a housing which is an external frame part of the keyboard 1 having the backlight function, by a claw or the like.

The light guide plate 40 is formed of a plate-shaped member having light permeability such as acrylic resin or polycarbonate. The material of the light guide plate 40 has an elasticity higher than that of the support panel 30. A FPC (flexible printed circuit) having a light emitting diode 42 as a light source is provided at a side surface of the light guide plate 40. In addition, the reflection sheet 45 configured to reflect the light is provided at the rear surface side of the light guide plate 40.

Under this structure, the light emitted by the light emitting diode 42 is irradiated from the side surface of the light guide plate 40 so as to be spread inside the light guide plate 40. Since the reflection sheet 45 is provided at the rear surface, all of the light spread inside the light guide plate 40 is led to a surface where the key tops 10 are provided without leaking to the rear surface side. This light passes through the opening parts 32 of the support panel 30 so as to permeate the membrane sheet 20, the rubber actuator 22, the housing part 12 and the gear link 11 made of the transparent or translucent resin, and the light permeating region 10*b* of the key top 10 and then be emitted to the outside.

Since the light resistant region 10*a* is provided in the key top 10, the light is blocked and does not leak to the outside in the light resistant region 10*a*. Accordingly, the key top 10 emits the light in the character or mark configuration of the light permeating region 10*b*.

In the meantime, due to demands of recent thin-type keyboards, the support panel 30 is frequently formed so as to have a thickness of approximately 0.2 mm through approximately 0.5 mm. As discussed above, the support panel 30 is fixed to the housing by the claw or the like. However, since the thin member is used as the support panel 30, the support panel 30 may be deformed due to impact or the like at the time of assembling.

Because of this, in the keyboard 1 having the backlight function, as seen from the top side, all circumferential parts of the external edge part of the light guide plate 40 project outside the support panel 30.

Figure 2B:
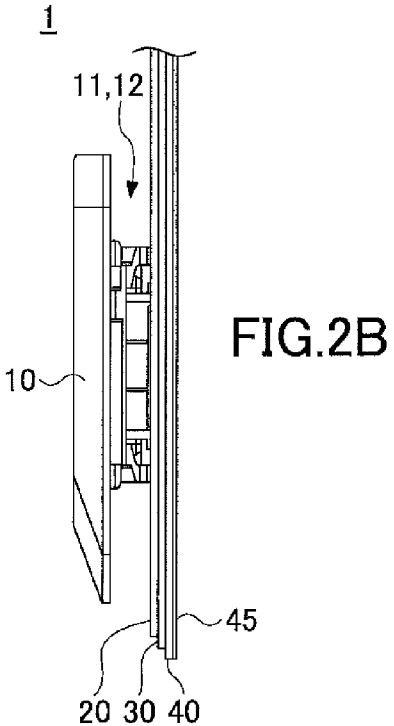
FIG. 2B is a diagram for illustrating an X view of the structure of the keyboard 1.
Figure 2A:
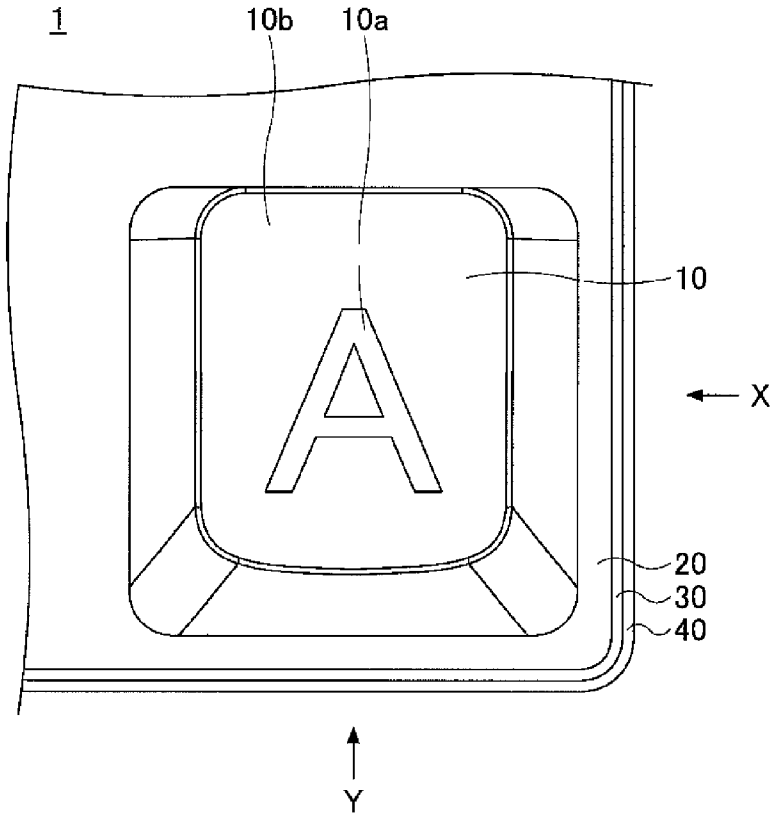
FIG. 2A is a diagram for illustrating a plane view of a structure of the keyboard 1 having the backlight function of the first embodiment of the present invention.
Figure 2C:
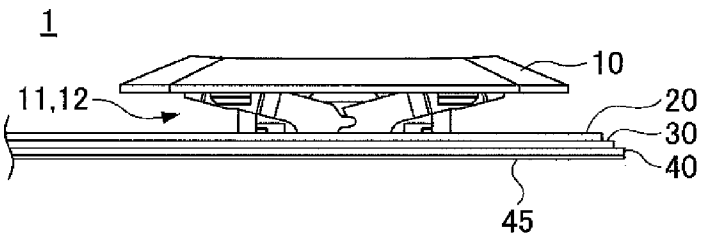
FIG. 2C is a diagram for illustrating a Y view of the structure of the keyboard 1.

FIGS. 2(A)-2(C) are views for explaining a structure of the keyboard 1 having the backlight function of the first embodiment of the present invention. More specifically, FIG. 2(A) is a partial plan view of the keyboard 1 having the backlight function. FIG. 2(B) is a partial side view of the keyboard 1 having the backlight function, seen in an X direction in FIG. 2(A). FIG. 2(C) is a partial side view of the keyboard 1 having the backlight function, seen in a Y direction in FIG. 2(A).

As shown in FIGS. 2(A)-2(C), in the keyboard 1 having the backlight function, the external edge part of the light guide plate 40 projects to the outside the most. The projection amount of the support panel 30 is smaller than the projection amount of the light guide plate 40. The projection amount of the membrane sheet 20 is smaller than the projection amount of the support panel 30.

With this structure, the light guide plate 40 protects the support panel 30 at the time of assembling and therefore it is possible to easily assemble the keyboard 1. Since the gear link 11 is fixed via the housing 12 to the support panel 30 made of metal, the rigid feeling of the keyboard is not degraded.

It may be preferable that the same light-resistant paint as that applied to the light resistant region 10*a* of the key top 10 be applied to a part of the light guide plate 40 projecting outside relative to the support panel 30. With this structure, it is possible to prevent the light from leaking from the external sides of the light guide plate 40 and to make manufacturing processes easy. This is because, during a process where the key top 10 is painted, the light guide plate 40 may be painted with the same paint in a lump. This can be applied to other embodiments discussed below.

According to the keyboard 1 having the backlight function of the first embodiment of the present invention, the rigid feeling of the keyboard 1 is not degraded and assembling of the keyboard 1 can be made easy.

Second Embodiment

A keyboard 2 having a backlight function of a second embodiment of the present invention is discussed with reference to FIGS. 3(A)-3(C).

Figure 3B:
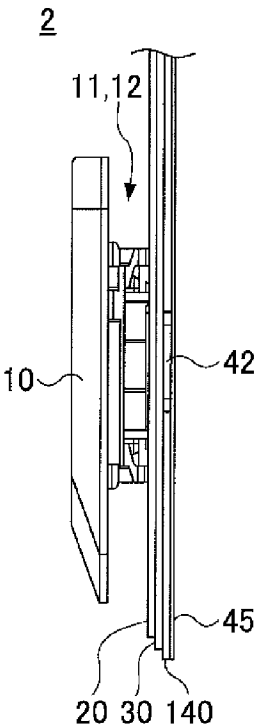
FIG. 3B is a diagram for illustrating an X view of the structure of the keyboard 2.
Figure 3A:
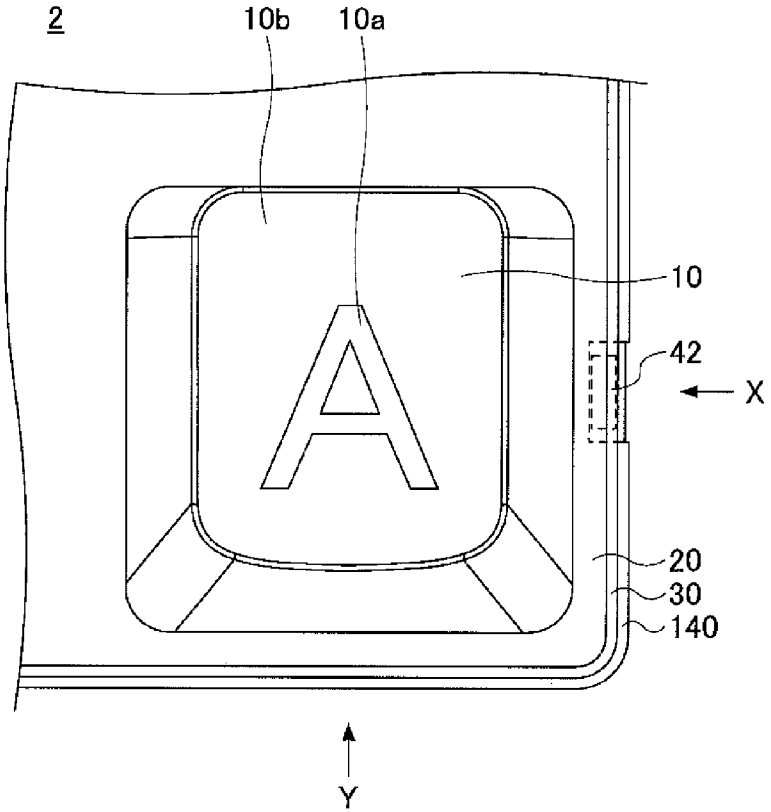
FIG. 3A is a diagram for illustrating a plane view of a structure of a keyboard 2 having a backlight function of a second embodiment of the present invention.
Figure 3C:
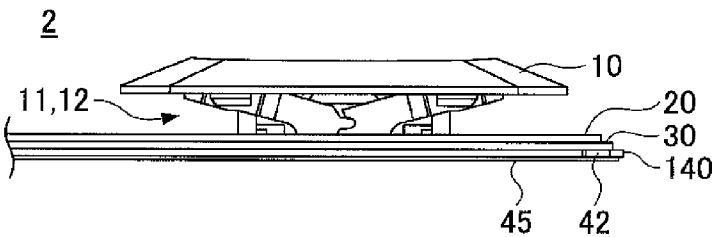
FIG. 3C is a diagram for illustrating a Y view of the structure of the keyboard 2.

FIGS. 3(A)-3(C) are views for explaining a structure of a keyboard 2 having the backlight function of the second embodiment of the present invention. More specifically, FIG. 3(A) is a partial plan view of the keyboard 2 having the backlight function. FIG. 3(B) is a partial side view of the keyboard 2 having the backlight function, seen in an X direction in FIG. 3(A). FIG. 3(C) is a partial side view of the keyboard 2 having the backlight function, seen in a Y direction in FIG. 3(A).

As shown in FIGS. 3(A)-3(C), in the keyboard 2 having the backlight function, as well as the keyboard 1 of the first embodiment, the external edge part of a light guide plate 140 projects to the outside the most. The projection amount of the support panel 30 is smaller than the projection amount of the light guide plate 140. The projection amount of the membrane sheet 20 is smaller than the projection amount of the support panel 30.

In this embodiment, a concave part is formed in the light guide plate 140. The concave part is configured to receive the light emitting diode 42. The external edge part of the light guide plate 140 except the concave part projects outside of the support panel 30.

With this structure, a portion including the light emitting diode 42 can be made compact and received. The size of the light guide plate 140 can be made sufficiently large relative to the size of the keyboard 2.

According to the keyboard 2 having the backlight function of the second embodiment of the present invention, the rigid feeling of the keyboard 2 is not degraded and assembling of the keyboard 2 can be made easy. In addition, it is possible to make the size of the light guide plate 140 sufficiently large relative to the size of the keyboard 2.

Third Embodiment

A keyboard 3 having a backlight function of a third embodiment of the present invention is discussed with reference to FIGS. 4(A)-4(B).

Figure 4A:
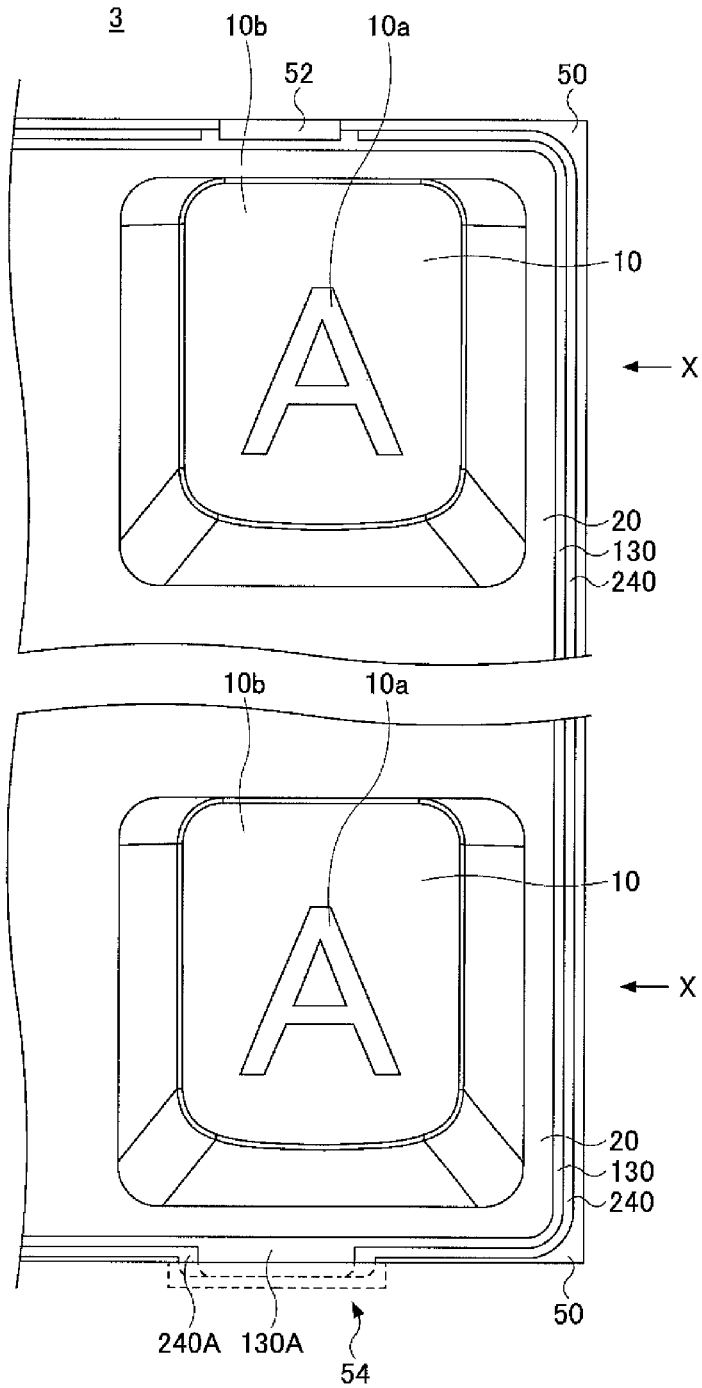
FIG. 4A is a diagram for illustrating a plane view of a structure of a keyboard 3 having a backlight function of a third embodiment of the present invention.
Figure 4B:
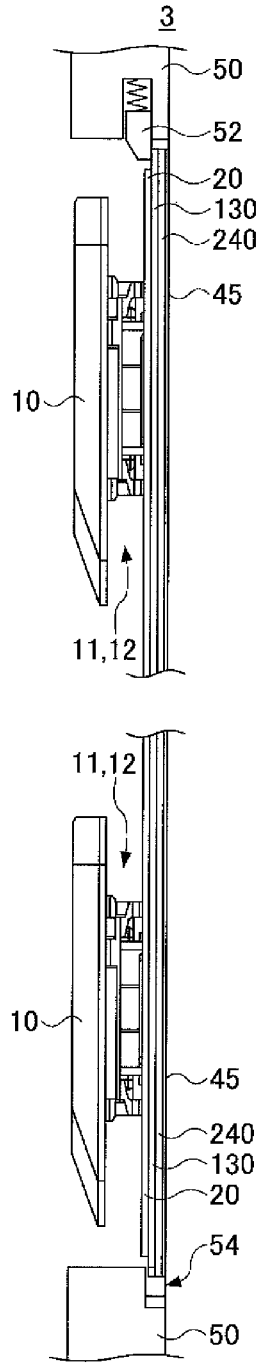
FIG. 4B is a diagram for illustrating an X view of the structure of the keyboard 3.

FIGS. 4(A)-4(B) are views for explaining a structure of the keyboard 3 having the backlight function of the third embodiment of the present invention. More specifically, FIG. 4(A) is a partial plan view of the keyboard 3 having the backlight function. FIG. 4(B) is a partial side view of the keyboard 3 having the backlight function, seen in an X direction in FIG. 4(A).

As shown in FIGS. 4(A)-4(B), in the keyboard 3 having the backlight function, as well as the keyboard 1 of the first embodiment, the external edge part of a light guide plate 240 projects to the outside the most. The projection amount of a support panel 130 is smaller than the projection amount of the light guide plate 240. The projection amount of the membrane sheet 20 is smaller than the projection amount of the support panel 130.

In this embodiment, at a portion where a housing 50 fixes the support panel 130, the external edge part of the support panel 130 has the same size or is larger than the external edge part of the light guide plate 240. Other than this portion, the light guide plate 240 projects outside the support panel 130.

The housing 50 may fix the support panel 130 as shown in upper sides of FIGS. 4(A)-4(B). That is, the support panel 130 may be fixed by a claw part 52 projecting from the housing 50. Alternatively, the housing 50 may fix the support panel 130 as shown in lower sides of FIGS. 4(A)-4(B). That is, the support panel 130 may be fixed by press fitting a projection part 130A of the support panel 130 and a projection part 240A of the light guide plate 240 into a concave part 54 provided in the housing 50.

With this structure, the housing 50 can securely hold the entire keyboard 3. This is because the support panel 130 having the highest rigidity among components forming the keyboard 3 is directly fixed by the housing 50.

According to the keyboard 3 having the backlight function of the third embodiment of the present invention, the rigid feeling of the keyboard is not degraded and assembling of the keyboard 3 can be made easy. In addition, the housing 50 can securely hold the keyboard 3.

It is preferable to combine the second embodiment and the third embodiment of the present invention. In other words, the external edge part of the light guide plate may project more than the support panel 130 at a portion other than the concave part configured to receive the light emitting diode 42 and the portion where the housing 50 is fixed to the support panel 130. With this structure, the rigid feeling of the key board is not degraded; assembly can be made easy; the size of the light guide plate can be made sufficiently large relative to the size of the keyboard; and the entire keyboard can be securely held by the housing.

Fourth Embodiment

A keyboard 4 having a backlight function of a fourth embodiment of the present invention is discussed with reference to FIGS. 5(A)-5(C).

Figure 5B:
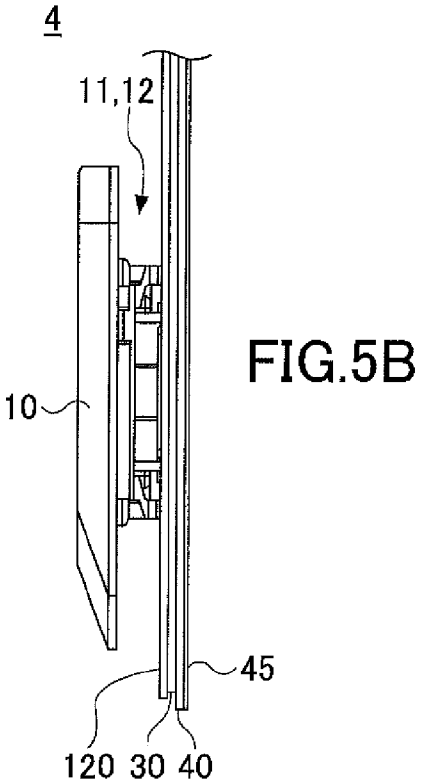
FIG. 5B is a diagram for illustrating an X view of the structure of the keyboard 4.
Figure 5A:
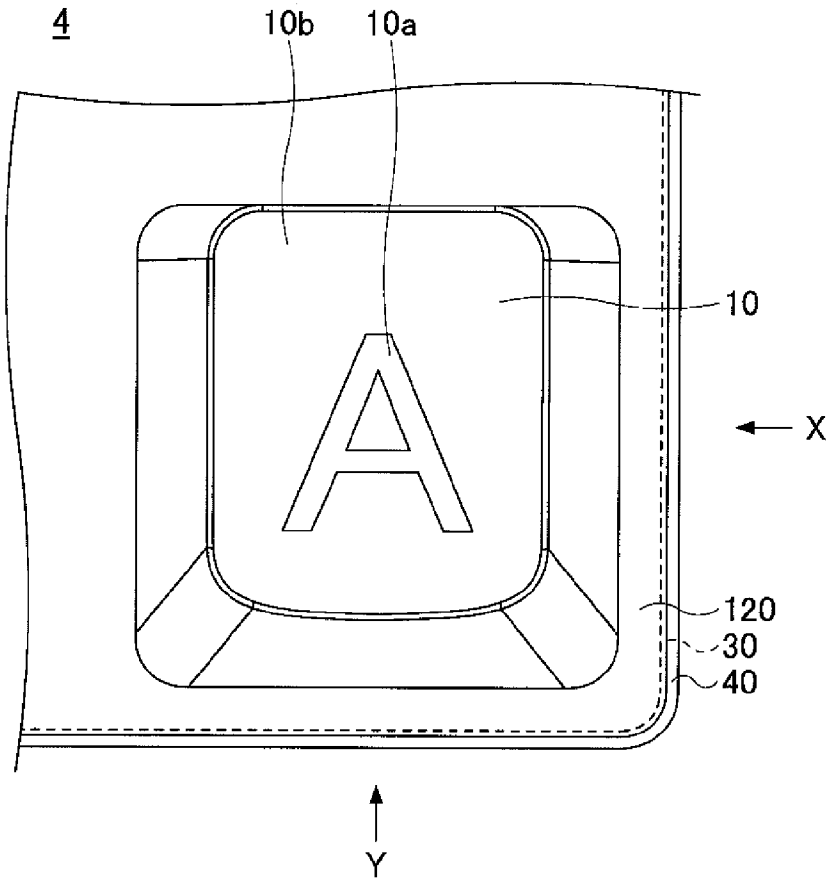
FIG. 5A is a diagram for illustrating a plane view of a structure of a keyboard 4 having a backlight function of a fourth embodiment of the present invention.
Figure 5C:
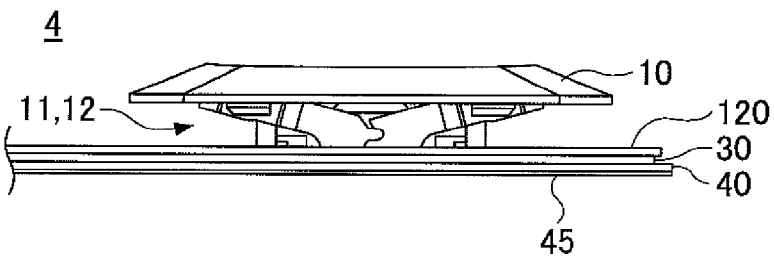
FIG. 5C is a diagram for illustrating a Y view of the structure of the keyboard 4.

FIGS. 5(A)-5(C) are views for explaining a structure of the keyboard 4 having the backlight function of the fourth embodiment of the present invention. More specifically, FIG. 5(A) is a partial plan view of the keyboard 4 having the backlight function. FIG. 5(C) is a partial side view of the keyboard 4 having the backlight function, seen in an X direction in FIG. 5(A). FIG. 5(C) is a partial side view of the keyboard 4 having the backlight function, seen in a Y direction in FIG. 5(A).

A membrane sheet 120 of the fourth embodiment, as well as the membrane sheet 20 of the first through third embodiment, is formed of a member having the elasticity higher than that of the support panel 30. In addition, the membrane sheet 120 has a configuration projecting outside the support panel 30 along the entire circumference seen from the top side.

With this structure, at the time of assembling the keyboard 4, the light guide plate 40 and the membrane sheet 120 protect the support panel 30 and assembling of the keyboard 4 can be made easy.

According to the keyboard 4 having the backlight function of the fourth embodiment of the present invention, the rigid feeling of the keyboard is not degraded and assembling of the keyboard 4 can be made easy.

Fifth Embodiment

A keyboard 5 having a backlight function of a fifth embodiment of the present invention is discussed with reference to FIGS. 6(A)-6(C).

Figure 6B:
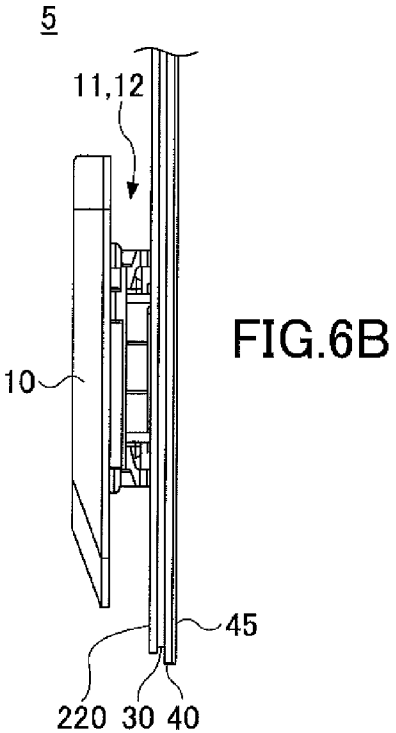
FIG. 6B is a diagram for illustrating an X view of the structure of the keyboard 5.
Figure 6A:
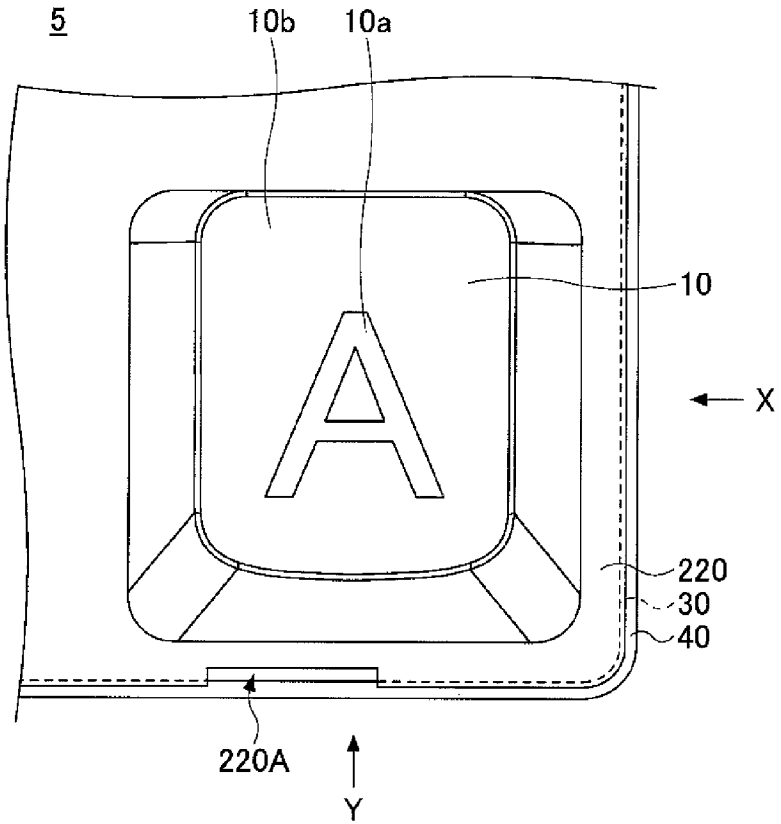
FIG. 6A is a diagram for illustrating a plane view of a structure of a keyboard 5 having a backlight function of a fifth embodiment of the present invention.
Figure 6C:
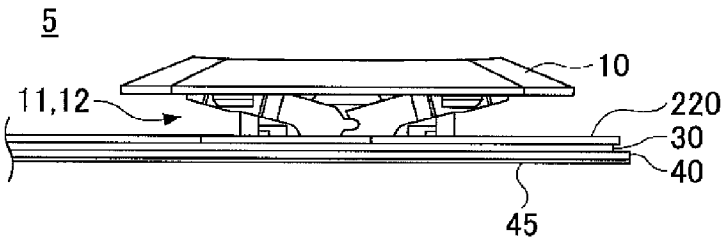
FIG. 6C is a diagram for illustrating a Y view of the structure of the keyboard 5.

FIGS. 6(A)-6(C) are views for explaining a structure of the keyboard 5 having the backlight function of the fifth embodiment of the present invention. More specifically, FIG. 6(A) is a partial plan view of the keyboard 5 having the backlight function. FIG. 6(B) is a partial side view of the keyboard 5 having the backlight function, seen in an X direction in FIG. 6(A). FIG. 6(C) is a partial side view of the keyboard 5 having the backlight function, seen in a Y direction in FIG. 6(A).

A membrane sheet 220 of the fifth embodiment, as well as the membrane sheet 120 of the fourth embodiment, is formed of a member having the elasticity higher than that of the support panel 30. In addition, the membrane sheet 220 has a configuration projecting outside the support panel 30 along most of the entire circumference seen from the top side.

In this embodiment, at a portion where the support panel 30 is fixed to the housing 50, a notch part 220A of the membrane sheet 220 is formed. At this portion, the claw part 52 of the housing 50 directly comes in contact with the support panel 30.

With this structure, the entire keyboard 5 can be securely held by the housing 50. This is because the support panel 30 having the highest rigidity among components forming the keyboard is directly fixed by the housing 50.

According to the keyboard 5 having the backlight function of the fifth embodiment of the present invention, the rigid feeling of the keyboard 5 is not degraded and assembling of the keyboard 5 can be made easy. In addition, the housing 50 can securely hold the keyboard 5.

Figure 7:
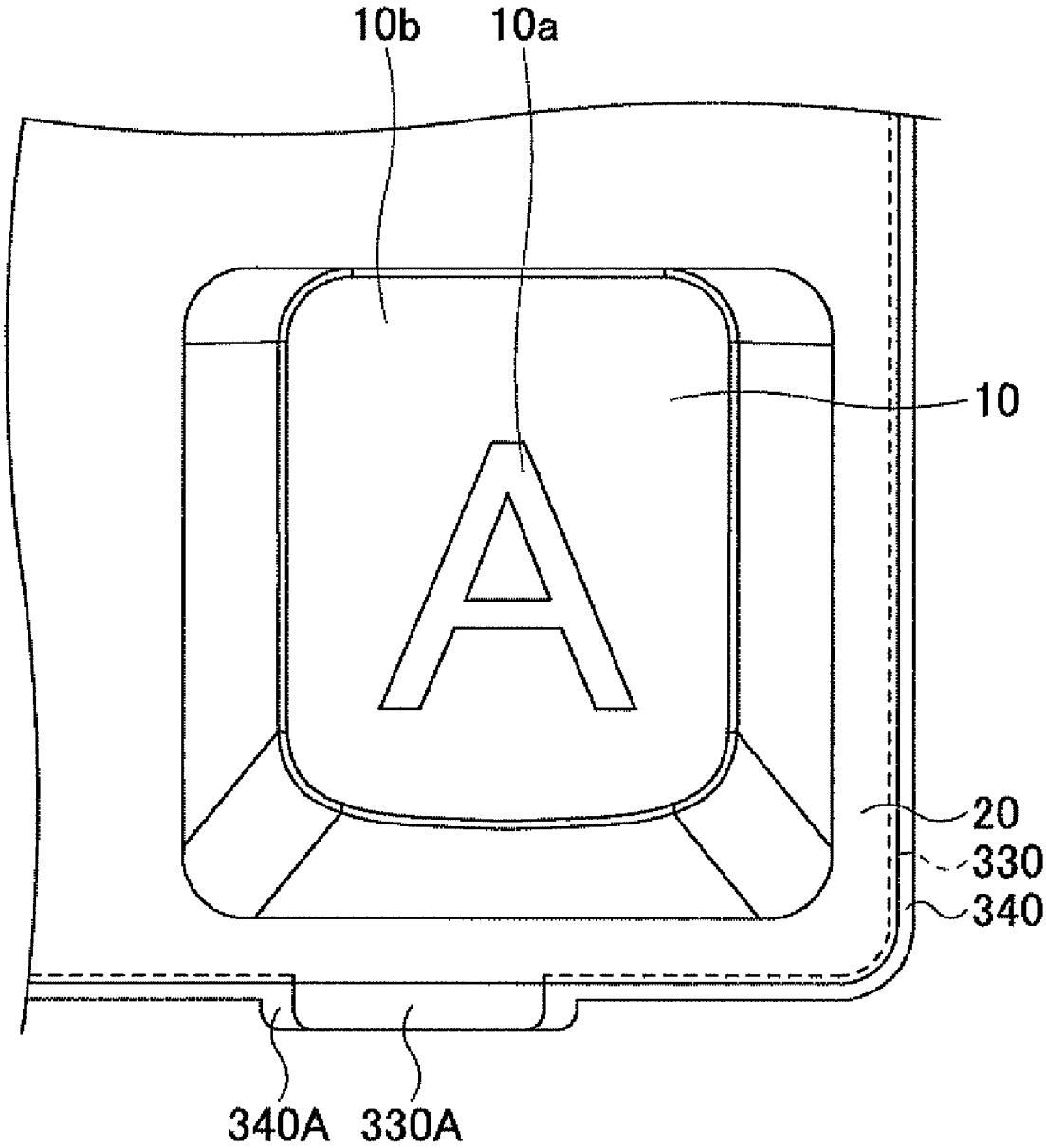
FIG. 7 is a view showing a structure where a projection part 30A of a support panel 30 and a projection part 40A of a light leading plate 40 project from an external edge part of a membrane sheet 20 to an outside.

In a case where the support panel and others are fixed to the housing 50 by the concave part 54 as shown in FIGS. 4(A)-4(B), the notch part 20A may not be formed in the membrane sheet 20 (see FIG. 6(A)) and a projection part 330A of a support panel 330 and a projection part 340A of a light guide plate 340 may project from an external edge part of the membrane sheet 20 to the outside (see FIG. 7).

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

Figure 8:
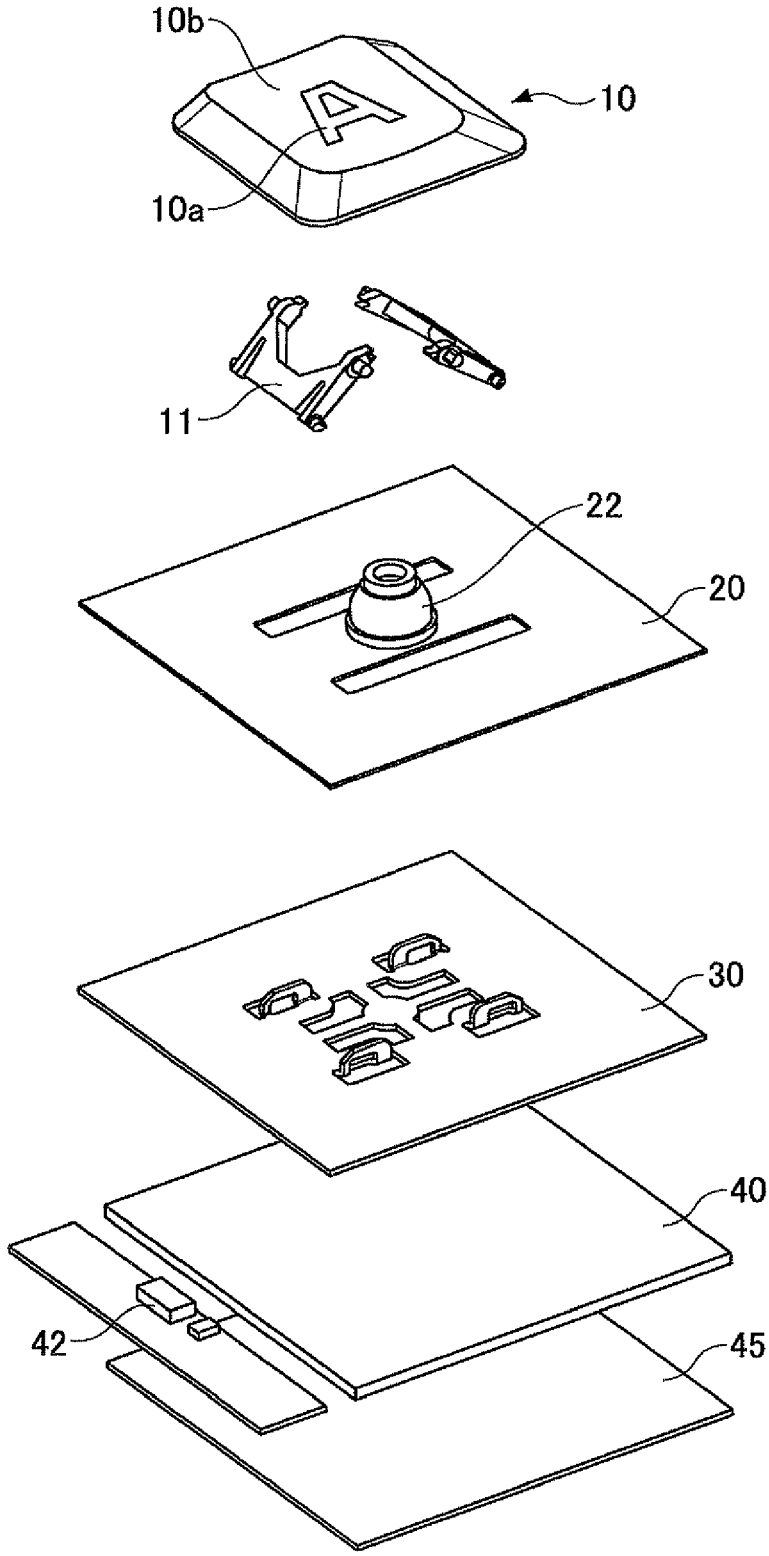
FIG. 8 is a view showing where an example of the present invention is applied to a switch panel-less type keyboard.
Figure 9:
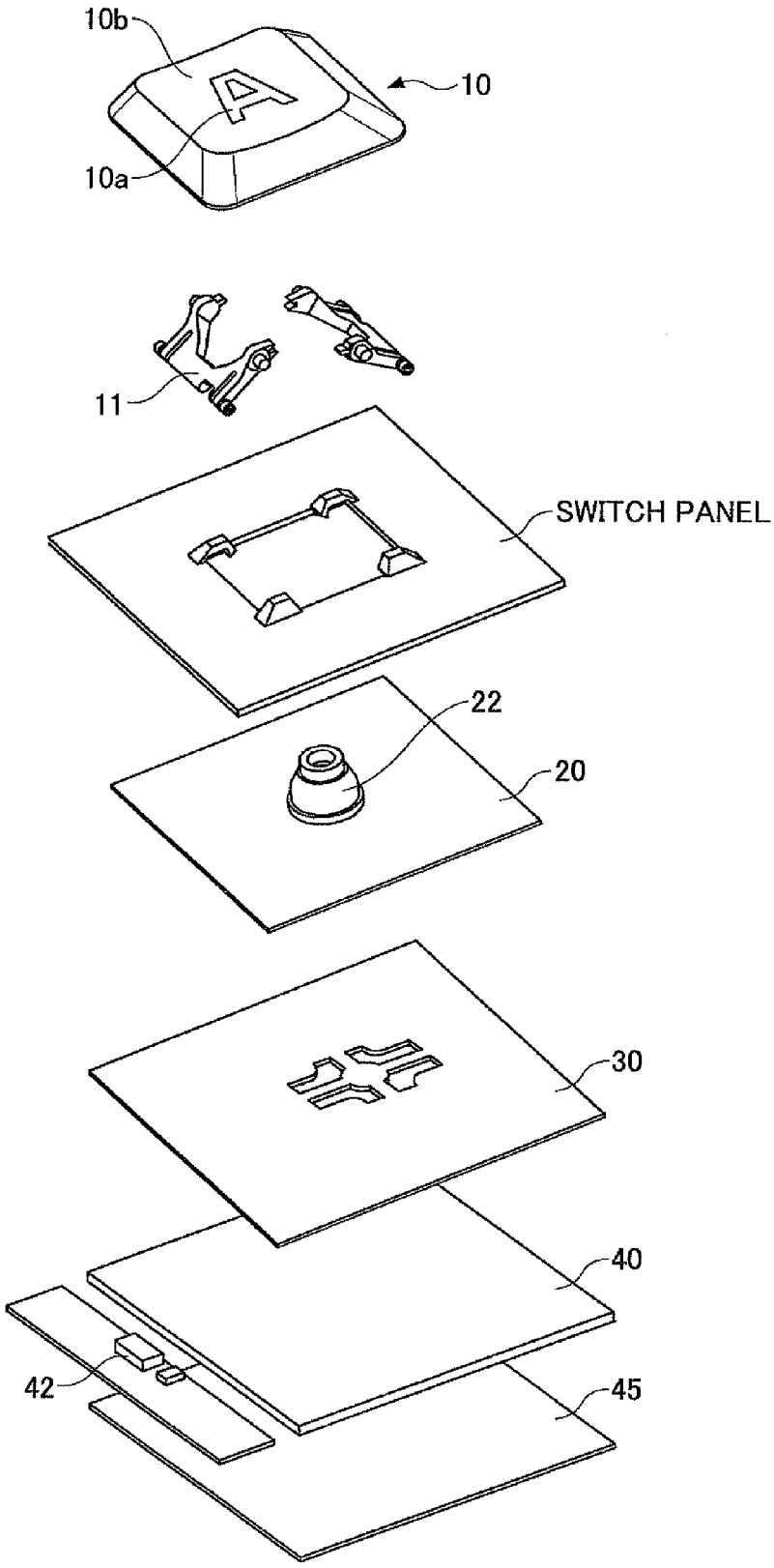
FIG. 9 is a view showing where an example of the present invention is applied to a switch panel type keyboard.

For example, the present invention is not limited to a pieced housing type keyboard shown in FIG. 8. The present invention can be applied to a switch panel-less type keyboard shown in FIG. 9. In this case, the support panel 30 is not fixed to the gear link 11. A part of the external edge part of the light guide plate 40 projects outside more than the support panel 30 fixed to the housing.

According to the embodiments of the present invention, it is possible to provide a keyboard having a backlight function, the keyboard including: a key top having a light permeating region, the key top being where one end of a link member is provided; a membrane sheet having a contact, the contact being conductive when the key top is pushed; a support panel made of metal, the support panel being where another end of the link member is provided; and a light guide plate where a light is guided from a light source; wherein the key top, the membrane sheet, the support panel, and the light guide plate are stacked from a top side; the light guide plate is formed of a member having an elasticity higher than an elasticity of the support panel; and a part of an external edge part of the light guide plate, seen from the top side, projects outside the support panel.

Here, the top side means a side where the key top is provided, that is, a side where the user looks down at the keyboard.

According to this keyboard, the link member is fixed by the metal support panel. Therefore, a rigid feeling of the keyboard is not degraded. In addition, the light guide plate is formed of the member having the elasticity higher than then elasticity of the support panel. Furthermore, the part of the external edge part of the light guide plate projects outside the support panel. With this structure, at the time of assembling the keyboard, the light guide plate protects the support panel and assembling of the keyboard can be made easy.

It is also possible to provide a keyboard having a backlight function, the keyboard including: a key top having a light permeating region, the key top being where one end of a link member is provided; a switch panel where another end of the link member is provided; a membrane sheet having a contact, the contact being conductive when the key top is pushed; a support panel fixed to a housing; and a light guide plate where a light is guided from a light source; wherein the key top, the switch panel, the membrane sheet, the support panel, and the light guide plate are stacked from a top side; the light guide plate is formed of a member having an elasticity higher than an elasticity of the support panel; and a part of an external edge part of the light guide plate, seen from the top side, projects outside the support panel.

Thus, according to the embodiments of the present invention, it is possible to assemble the keyboard without degrading a rigid feeling of the keyboard.

The present invention can be applied to manufacturing of computers or peripheral devices.

What is claimed is:

1. A keyboard, comprising:

a support panel made of metal;

a key top having a light permeating region, the key top being attached to the support panel via a link member;

a membrane sheet having a contact, the contact being conductive when the key top is pushed, the membrane sheet being stacked on the support panel;

a light source; and a light guide plate where a light is guided from a light source, the light guide plate having an elasticity higher than an elasticity of the support panel;

wherein all circumferential parts of an external edge part of the light guide plate projects outside an external edge part of the support panel.

2. A keyboard having a backlight function, the keyboard comprising:

a key top having a light permeating region, the key top being where one end of a link member is provided;

a switch panel where another end of the link member is provided;

a membrane sheet having a contact, the contact being conductive when the key top is pushed;

a support panel fixed to a housing which holds the entire keyboard; and a light guide plate where a light is guided from a light source;

wherein the key top, the switch panel, the membrane sheet, the support panel, and the light guide plate are stacked from a top side; the light guide plate is formed of a member having an elasticity higher than an elasticity of the support panel; and an external edge part of the light guide plate, seen from the top side, projects outside the support panel at four sides of the light guide plate.

3. A keyboard having a backlight function, the keyboard comprising:

a key top having a light permeating region, the key top being where one end of a link member is provided;

a membrane sheet having a contact, the contact being conductive when the key top is pushed;

a support panel made of metal, the support panel being where another end of the link member is provided; and a light guide plate where a light is guided from a light source;

wherein the key top, the membrane sheet, the support panel, and the light guide plate are stacked from a top side; the light guide plate is formed of a member having an elasticity higher than an elasticity of the support panel; and an external edge part of the light guide plate, seen from the top side, projects outside the support panel at four sides of the light guide plate.

4. The keyboard having the backlight function as claimed in claim 3, wherein all the external edge part of the light guide plate projects outside the support panel.

5. The keyboard having the backlight function as claimed in claim 3, wherein the external edge part of the light guide plate projects outside the support panel, at a portion other than a concave part of the light guide plate where the light source is received.

6. The keyboard having the backlight function as claimed in claim 3, wherein the external edge part of the light guide plate projects outside the support panel, at a portion other than a portion where a housing which holds the entire keyboard is fixed to the support panel.

7. The keyboard having the backlight function as claimed in claim 3, wherein the external edge part of the light guide plate projects outside the support panel, at a portion other than a concave part of the light guide plate where the light source is received and a portion where a housing which holds the entire keyboard is fixed to the support panel.

8. The keyboard having the backlight function as claimed in claim 3, wherein a light resistant paint is applied to a portion of the light guide plate projecting outside the support panel.

9. The keyboard having the backlight function as claimed in claim 3, wherein the support panel, seen from the top side, projects outside the membrane sheet.

10. The keyboard having the backlight function as claimed in claim 3, wherein the membrane sheet is formed of a member having an elasticity higher than an elasticity of the support panel; and a part of an external edge part of the membrane sheet, seen from the top side, projects outside the support panel.

11. The keyboard having the backlight function as claimed in claim 10, wherein the external edge part of the membrane sheet projects outside the support panel, at a portion other than a portion where a housing which holds the entire keyboard is fixed to the support panel.

* * * * *